United States Patent [19]

Schaeff

[11] Patent Number: 4,571,147

[45] Date of Patent: Feb. 18, 1986

[54] SHOVEL EXCAVATOR WITH MODIFIED UPPER CARRIAGE DESIGN

[75] Inventor: Hans Schaeff, Langenburg, Fed. Rep. of Germany

[73] Assignee: Karl Schaeff GmbH & Co. Maschinenfabrik, Langenburg, Fed. Rep. of Germany

[21] Appl. No.: 630,642

[22] Filed: Jul. 13, 1984

[30] Foreign Application Priority Data

Jul. 14, 1983 [DE] Fed. Rep. of Germany ..... 3325405

[51] Int. Cl.[4] ..... E02F 3/32

[52] U.S. Cl. ..... 414/694; 414/687

[58] Field of Search ..... 414/694, 695, 695.5, 414/695.6, 695.7, 695.8, 687; 37/103

[56] References Cited

U.S. PATENT DOCUMENTS

| | | | |
|---|---|---|---|
| 3,167,194 | 1/1965 | Davis et al. | 414/695 |
| 3,173,561 | 3/1965 | Brocklebank et al. | 414/694 |
| 3,586,113 | 6/1971 | Grant | 37/103 X |
| 4,183,711 | 1/1980 | Schaeff | 414/695 |
| 4,261,684 | 4/1981 | Norton et al. | 414/695 |
| 4,378,193 | 3/1983 | Schaeff | 414/695 |

FOREIGN PATENT DOCUMENTS

| | | | |
|---|---|---|---|
| 971028 | 9/1964 | United Kingdom | 414/695.5 |

*Primary Examiner*—Clifford D. Crowder

*Attorney, Agent, or Firm*—Shlesinger, Arkwright, Garvey & Fado

[57] ABSTRACT

A shovel excavator with an upper carriage pivoting unrestrictedly on an undercarriage and with an attachment holder (6) for a boom (8) pivoting laterally at the front. The pivot shaft (5) is located a distance corresponding to at least half the conventional shovel width from the front edge (22) of the operator cab, so that when the boom is pivoted transversely and the shovel post (10) is folded up, together with the excavating shovel (11), this assembly remains within the contour of the upper carriage. Unhampered view forward and on the ground through the folded-up boom assembly is provided to the operator cab. The second pivot shaft (5) is located in the area between the travel track and the longitudinal center line L of the vehicle in one main excavating position of the upper carriage. Neither in the travel position nor in the main excavating position do the side walls of the upper carriage project laterally beyond the undercarriage.

12 Claims, 6 Drawing Figures

SHOVEL EXCAVATOR WITH MODIFIED UPPER CARRIAGE DESIGN

Figure 1:
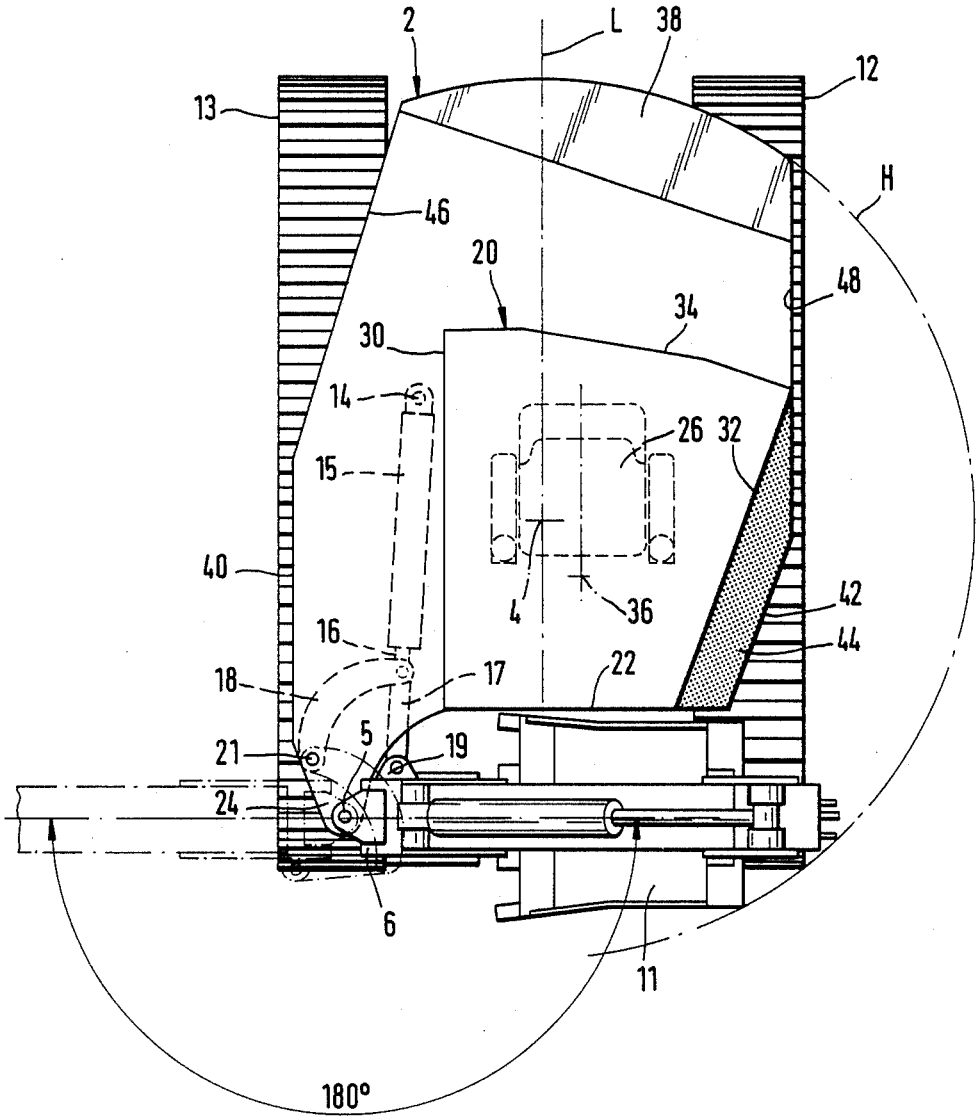

The invention concerns a shovel excavator of the general type described in German Pat. No. 2,558,799. The known design includes a guide means in front of the operator cab and transverse to the longitudinal axis of the upper carriage, a sled being transversely displaceable on said guide means and pivotably supporting the mounted attachment holder. In order to excavate parallel to the longitudinal axis of the vehicle at a useful lateral pivot approximately in extension of the particular travel track, the guide means is made to project on both sides of the upper carriage. Accordingly, the guide means assumes a substantial length so that when the sled is in the lateral end position, the excavating boom is pivoted transversely in front of the guide means with the folded-up shovel remains within the envelope circle determined by the counterweight at the upper carriage, so that the excavator can be pivoted within the narrowest space possible.

It is the object of the invention to improve a shovel excavator of the initially cited design to such an extent that it shall be possible to excavate with a large lateral pivot with minor expenditures in construction and actuation, and so that the operator shall enjoy good visibility both when driving and when working, either in the main excavating position or when the boom is laterally offset from the central longitudinal axis of the undercarriage.

In contrast with the initially cited state of the art, this problem is solved by the invention by the characterizing features (a) through (e) of the claim 1. As regards that basic design, it is possible to pivot the boom assembly, which is supported along the upper carriage, with a lateral offset within the narrowest possible space away from the operator cab in a very simple manner, whereby in the case of a restricted work site, the excavated material, after approaching and pivoting the upper carriage, can be discharged rearwardly. The convenient transverse pivoting motion of the assembly furthermore serves—in the travel position—to concentrate the overall center of gravity into the area of the undercarriage, as a result of which the operator, because of the angled boom and the resulting central clear space and the operator's cab being located centrally in the upper carriage with a clear front side, enjoys an unobstructed view.

In another important embodiment of the invention, the upper carriage does not laterally project beyond the undercarriage either when it is in the travel position, wherein the boom assembly is transversely pivoted into one of the end positions, or when in the main excavating position, wherein the second shaft is located in the area between the travel track and the center line of the vehicle longitude. As a result, the operator is able to set his boom in the longitudinal direction between the two travel tracks just as in the conventional excavators, such a procedure requiring relatively little attention. Lateral limiting segments are provided at the upper carriage and extend approximately parallel to the particular travel track in either position, and it is therefore an easy matter for the operator to orient himself by means of these limiting segments or else to align them with the travel track when he is pivoting from one position into the other.

Besides the main excavating position and the travel position, wherein the upper carriage does not project at least laterally beyond the undercarriage, an arbitrary number of pivot positions of the upper carriage are possible in order to excavate at a more or less pronounced lateral pivot, the spacing between the first and the second pivot shafts preferably is such that the second vertical shaft can be pivoted beyond the particular travel track so that it is possible to excavate outside the travel tracks. It is furthermore highly significant in practice that excavations can be carried out by the shovel excavator of the invention both from the main excavating position and from the travel position by setting the boom transversly to the longitudinal axis of the undercarriage, for instance the excavation of ditches or ramps of streets or railway tracks where the upper carriage is not allowed to project beyond the outer edge of the undercarriage and where accordingly any pivot motion of the upper carriage must be suppressed. Such works often require to work on the ramp up to the undercarriage or the rail, to be flush with the ramp or the perform clean-up operations on it.

Appropriately, the segment of the angled boom starting from the attachment holder, for the case of the approximately end position, extends at least to the eye level of the operator whereby the angled segment connected thereto does not hamper his clear view.

In another embodiment, the projection of the upper carriage, the attachment holder and the boom assembly or shovel assembly, which is pivoted in front of the cab, can be located within an envelope circle of which the radius exceeds that of the envelope arc about the counterweight. This will be the case, for instance, for smaller excavator types for which the particular boom length or the shovel width is too large to remain, when in the lateral end position, in the envelope circle determined by the counterweight at the upper carriage. In such cases, the contour circle is determined by the transversely pivoted boom assembly and said circle must be considered when the front side of the upper carriage must be pivoted past an obstacle. In order to fold as much of the boom assembly or possible against the upper carriage for work in restricted spaces, another feature of the invention provides a spacing between the second vertical shaft and the front edge of the upper carriage, said space corresponding approximately to one half the typical width of an excavating shovel.

In a preferred embodiment of the invention, the pivot system of the attachment holder consists of a hydraulic jack, linked inside the upper carriage, and connected directly, or through a coupling means with intermediate steering means, to the attachment holder. Even though any arbitrary pivot system can be used, the support of the attachment holder by the lateral projection of the upper carriage offers the possibility of conveniently storing an economical hydraulic jack, which in the case of direct control permits lateral pivot angles of up to 170° for the boom, sufficing in many cases, whereas a coupling transmission between the steering means can be used for still larger pivot angles.

Appropriately, the front edge of the upper carriage is formed, in part, by the front side of the cab in front and below which is mounted a protective grille. Due to this feature, the front pane of the cab can be extended to the bottom because the protective grille prevents any damages from the excavating shovel being pivoted past the front pane of the cab.

The shovel excavator of the invention is developed further in that the width of the upper carriage remains essentially within the width of the undercarriage for the travel position and in this position, a forward segment on the side next to the projection of the upper carriage and a back segment on the opposite side extend approximately in parallel to the outer limit of the undercarriage. This design endows the upper carriage with the maximum possible width without projecting beyond the undercarriage contours when in the travel position. The pivot angle of the upper carriage between the travel position and the main excavating position is not determined; in one embodiment it is roughly 20°. Such pivoting causes the second vertical shaft to move from the travel position of the upper carriage into an excavating position where it is located between the travel track and the central longitudinal line of the undercarriage, whereby the operator is seated somewhat laterally behind the boom just as in a conventional shovel excavator.

Appropriately, the center of gravity of the counterweight is located, when seen in topview and for the upper carriage pivoted into the main excavating position, approximately in the area of the center longitudinal line or fore-and-aft axis of the undercarriage. In this condition and when carrying out typical excavations, the counterweight amounts to the main part of the rest torque of the excavator.

So that the operator will be able to orient himself more easily when he is pivoting the upper carriage between the main excavating position and the travel position or vice-versa, the invention proposes that the side wall of the operator cab, which is next to the projection as seen in topview, extend parallel to the outer wall of the upper carriage connecting at the rear to the projection. Moreover, the cab side wall away from the projection can be approximately parallel to the undercarriage and to the outer wall segments of the upper carriage for the main excavating position of the upper carriage. Another orientation assistance for the operator is that the rotatably supported operator seat comprises at least one snapin position in which it is parallel to either of the cabin side walls. As a result, the operator cab with walls not parallel to each other nevertheless provides assistance in orientation of the operator in recognizing either of the main positions. It is to this point in this respect that the excavation controls are intergrated into the arm rests of the excavation seat which then presents itself to the operator in the same position in every pivot position.

An embodiment of the invention is discussed in further detail below in relation to the drawings.

Figure 2:
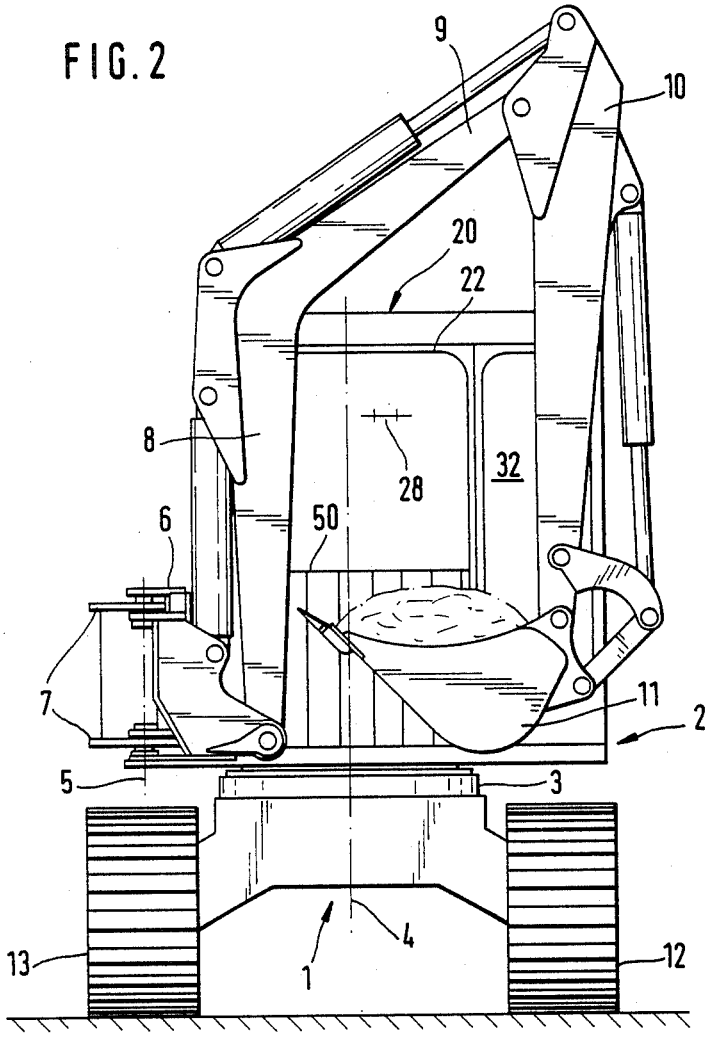
Figure 3:
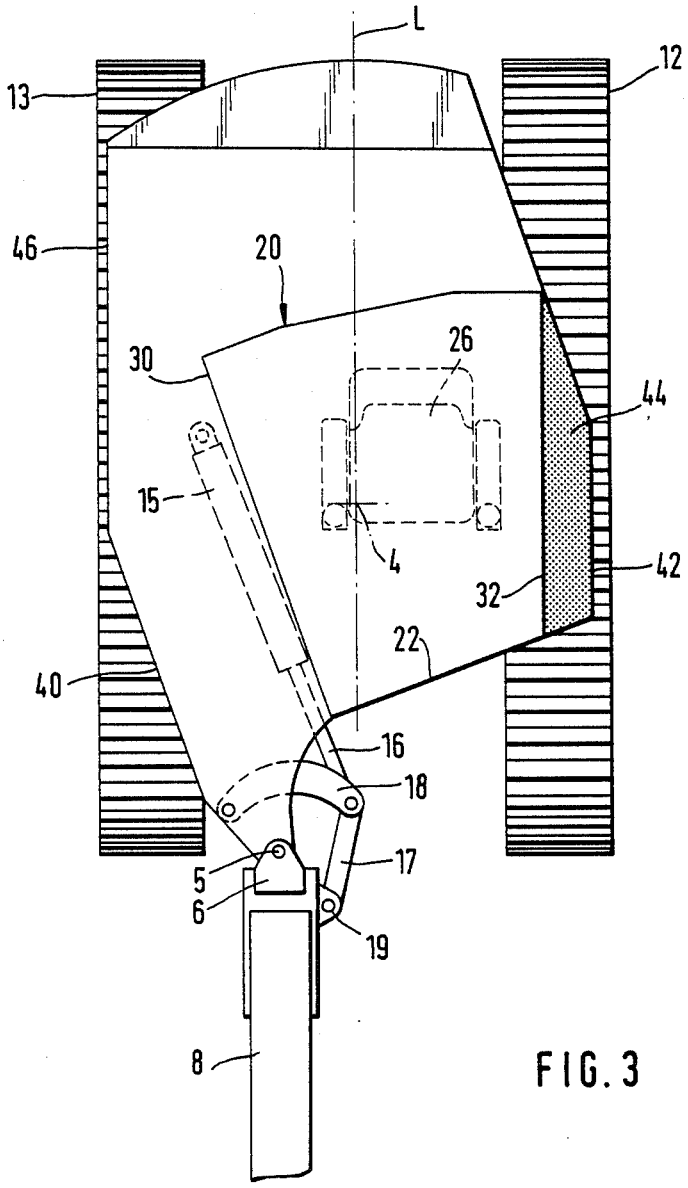
Figure 4:
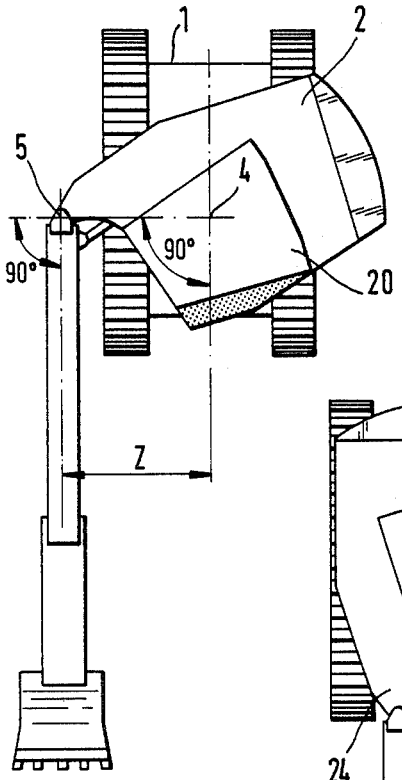
Figure 5:
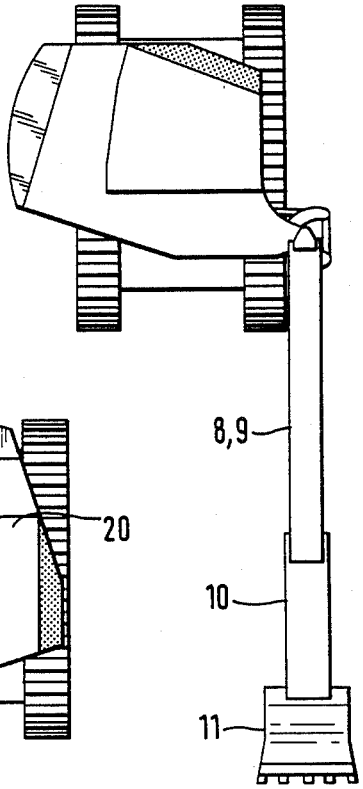
Figure 6:
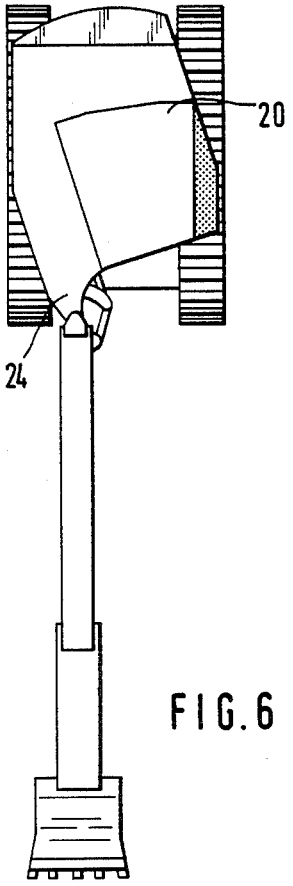

FIG. 1 is a top view of a shovel excavator of the invention with the upper carriage in the travel position, FIG. 2 is a front view of the excavator in the position of FIG. 1, FIG. 3 is a top view of the excavator of FIG. 1 where the upper carriage is pivoted into the main excavating position, FIG. 4, 5 and 6 are schematic top views of the shovel excavator of FIGS. 1–3 in a first sideways pivot position, in a second opposite sideways pivot position, and in the main excavating position, respectively.

As shown in FIGS. 1 and 2, an upper carriage 2 pivoting in unrestricted manner about a vertical shaft 4 is supported on an undercarriage 1 in the form of a caterpillar drive but which also may be a wheel and tire drive. The 360° pivoting motion is achieved using a known main pivot bearing 3 and by providing hydraulic feeds and line connectors.

Part of the lateral projection 24 forms the platform of the upper carriage and is located on the front side of the upper carriage 2 opposite the counterweight 38 and is designed to have an arcuate limit wall, a second vertical pivot shaft 5 is mounted on said projection 24.

An attachment holder 6 pivots about the second vertical shaft 5 and, as shown in FIG. 2, said attachment holder connects to a shovel assembly comprising an angled boom having a first angled boom portion and a second angled boom portion 8, 9, respectively shovel post 10 and an excavating shovel 11. The attachment holder 6 is held by upper and lower pivots pins in an attachment holder pivot bearing 7 consisting of upper and lower straps or integrated parts forming part of the projection 24 which issues from the platform of the upper carriage in the forward direction. FIG. 1 shows that the vertical spacing between the second pivot shaft 5 and the front edge of the upper carriage or from the cab front side 22 amounts to about half the width of a conventional excavating shovel 11, whereby the attachment holder and the boom can be pivoted essentially in parallel before the cab front side.

FIG. 2 furthermore shows that the boom segment 8 joined to the attachment holder 6 is of such a length, in the shown and folded-up position, that it extends above the eyelevel of the driver, as shown at 28 in FIG. 2. A central clear space remains between the boom segments 8 and 9, the shovel post 10 and the filled excavating shovel 11, and behind said clear space there is the front side 22 or eye level zone of the operator cab 20, whereby the operator enjoys unhampered view forward and on the ground before the undercarriage.

While the hydraulic jack to actuate the boom, the shovel post and the excavating tool are of conventional designs and therefore will not be described in further detail, a preferred embodiment includes a hydraulic jack 15, shown in FIG. 1, as the pivoting system for the attachment holder which in principle may also be replaced by another pivot system. The jack 15 extends within the upper carriage platform to the rear as far as a control point 14. The piston rod 16 is connected by a control link 17 to a lateral connection eye 19 at the attachment holder 6 and is guided by a kinematic coupler 18 which pivots about pin 21 mounted on the projection 24. The shown pivot drive permits the boom to pivot at least 180°, as indicated by FIG. 1, without, however, there being any restriction on this pivot angle. The essential operational positions shown in FIGS. 4, 5 and 6 can easily be achieved by means of this range of pivoting, in addition to the travel position of FIG. 1.

The FIGS. 1 and 3 jointly indicate the special relations between the outer lateral limits of the upper carriage 2 and the important main excavating and travel positions. For the travel position of FIG. 1, the lateral segment 40 of the upper carriage, which joins the projection 24, extends parallel to the right-hand undercarriage 13, i.e. as far as its edge when seen in the direction of travel. Similarly, a rear sidewall segment 48 extends on the opposite side of the upper carriage parallel to the left lateral boundry of the undercarriage or, the left propulsion means 12 or, where this propulsion means is a wheel works, parallel to the travel track formed by these wheels.

In a special feature of the excavator of the invention, the operator cab extends by a substantial amount as far as the first vertical shaft 4. The cab side wall 30 adjacent to the projection 24 is parallel to the side wall segment 40 of the upper carriage. Typical units such as the drive motor, the reservoir, hydraulic systems etc. are mounted behind and next to the cab.

As shown in FIG. 3, the upper carriage 2 is pivoted into the main excavating position wherein the vertical pivot shaft 5 of the attachment holder 6 is located about centrally between the right propulsion work 13 and the center longitudinal line or fore-and-aft axis L of the vehicle, though it might also be pivoted closer to the line L. In this pivot position, a rearward side wall segment 46 of the side wall of the upper carriage extends parallel to the propulsion work 13 and on the opposite side a front side wall segment 42 of the side vehicle extends parallel to the propulsion work 12. The center of gravity of the counterweight 38, in this main excavating position, is located approximately in the area of the longitudinal center line L of the vehicle. In order to set the upper carriage in the position of FIG. 3, the operator may make use of the cab side wall 32 which extends parallel to the segments 42, 46 of the upper carriage. The cab rear wall 34 may assume an arbitrary shape. To simplify operation, the operator seat 26 is provided with an excavating control shown integrated into the arm rests. In order to retain unhampered view forward in the main positions of the upper carriage of FIG. 1 and FIG. 3, the operator seat 26 may pivot about an axis 36 with at least one snap-in position being provided wherein the operator seat is parallel to the cab side wall 30 or to the opposite side wall 32. A footboard 44 permitting entry to the cab and the upper carriage can be provided between the side wall segment 42 and the adjacent cab side wall 32. The envelope circle H, shown in FIG. 1 and determined by the counterweight 38 on the upper carriage, also includes the folded-up boom assembly defining a clear space when in the travel position. It may be the case for more compact excavators that the boom assembly projects beyond this envelope circle H whereby, in such an instance, the envelope circle is determined by that assembly and would be of a larger radius than the outside edge of the counterweight 38. In a constricted work space it will be necessary then to take into account the envelope curve which is determinant for the front side of the upper carriage in order to prevent bumping into lateral obstacles when the upper carriage must be pivoted by 180°, for instace. It can be noted from FIG. 3 that the main excavating position is determinant for the design and the dimensions of the upper carriage and for its positional stability. The above described features can be implemented singly or plurally in arbitrary combinations for other embodiments of the invention omitted herefrom, without that thereby the scope of the invention shall have been exceeded; this also applies to the features of the claims which can be combined singly or in suitable arbitrary combinations to form other sets.

What is claimed is:

1. A mobile shovel excavator comprising:

(a) an undercarriage having a fore-and-aft axis and lateral boundaries;

(b) a polygonal upper carriage pivotable 360° about a vertical axis and positionable in at least a travel position and a main excavating position and upper carriage having a front edge including a lateral projection disposed adjacent one side of said upper carriage and an operator cab eccentrically mounted on said upper carriage opposite said lateral projection said operator cab having a front side eye level zone;

(c) a lateral projection vertical axis mounted to said lateral projection;

(d) an attachment holder pivotally mounted about said lateral projection vertical axis; and, (e) a shovel assembly comprising a first angled boom portion, a second angled boom portion, a shovel post, and a shovel said shovel assembly being positionable in a travel position defining a central clear space substantially coincident with said eye level zone.

2. A mobile shovel excavator according to claim 1, further comprising:

(a) a pivotably supported operator seat cabined within said cab, having a first snap-in position associated with said main excavating position whereby said operator seat and a first cab sidewall extend parallel to said fore-and-aft axis of said undercarriage; and, (b) said operator seat having a second snap-in position associated with said travel position of said upper carriage whereby, said seat and a second cab sidewall extend parallel to said fore-and-aft axis of said undercarriage.

3. A mobile shovel excavator according to claim 1, wherein:

(a) said polygonal upper carriage includes sidewalls which are maintained within the lateral boundries of said undercarriage in both said travel position and said main working position.

4. A mobile shovel excavator according to claim 3, wherein:

(a) said polygonal upper carriage side walls include forward and rearward outer wall sections defining the lateral boundries of the upper carriage, a first forward outer wall section joining said lateral projection and together with said oppositely disposed rearward outer wall section being substantially parallel to said undercarriage lateral boundries when said upper carriage is in said travel position; and, (b) a forward outer wall section on said side of said cab and an oppositely disposed rearward outer wall section of said upper carriage being substantially parallel to said undercarriage lateral boundries when said upper carriage is in said main excavating position.

5. A mobile shovel excavator according to claim 1, wherein:

(a) said projection vertical axis is at a distance from the front edge of the upper carriage corresponding to approximately half the conventional width of said excavating shovel.

6. A mobile shovel excavator according to claim 1, wherein:

(a) said front edge of said upper carriage is formed in part by the cab front side.

7. A mobile shovel excavator according to claim 6, wherein:

(a) said front side of said operator cab projects by a substantial amount beyond the vertical pivot axis of said upper carriage thereby allowing a front pane of said operator cab to be located directly behind said clear space.

8. A mobile shovel excavator according to claim 1, further comprising:

(a) a counterweight having a center of gravity substantially coincident with said fore-and-aft axis of said undercarriage when said upper carriage is in said main excavating position.

9. A mobile shovel excavator according to claim 4, wherein:

(a) a side wall of said operator cab, adjacent said lateral projection, extends substantially parallel to said first forward outer wall section joining said lateral projection.

10. A mobile shovel excavator according to claim 4, wherein:

(a) a cab side wall opposite said lateral projection extends substantially parallel to said forward outer wall section on the same side as said cab and in said main excavating position substantially parallel to said undercarriage lateral boundries.

11. A mobile shovel excavator according to claim 1, wherein:

(a) said upper carriage is provided with a first locking system to said undercarriage in which said travel position is defined by a cab sidewall, adjacent said lateral projection, being parallel to said fore-and-aft axis of said undercarriage; and, (b) a second locking system to said undercarriage in which said main excavating position is defined by a cab sidewall opposite said lateral projection being parallel to said fore-and-aft axis of said undercarriage.

12. A mobile shovel excavator comprising:

(a) an undercarriage having a fore-and-aft axis and lateral boundries;

(b) a polygonal upper carriage pivotable 360° about a vertical axis and positionable in at least a travel position and a main excavating position said upper carriage having a front edge including a lateral projection disposed adjacent one side of said upper carriage and an operator cab eccentrically mounted on said upper carriage opposite said lateral projection said operator cab having a front side eye level zone;

(c) a lateral projection vertical axis mounted to said lateral projection;

(d) an attachment holder pivotally mounted about said lateral portion vertical axis;

(e) a shovel assembly comprising a first angled boom portion, a second angled boom portion, a shovel post and a shovel said shovel assembly being positionable in a travel position defining a central clear space substantially coincident with said eye level zone;

(f) a pivotably supported operator seat, cabined within said cab, having a first snap-in position associated with said main excavating position said operator seat and a first cab sidewall extend parallel to said fore-and-aft axis of said undercarriage;

(g) said operator seat having a second snap-in position associated with said travel position of said upper carriage whereby, said seat and second cab sidewall extend parallel to said fore-and-aft axis of said undercarriage;

(h) said polygonal upper carriage sidewalls include forward and rearward outer wall sections defining lateral boundries of the upper carriage, a first forward outer wall section joining said lateral projection and together with said oppositely disposed rear outer wall section being substantially parallel to said undercarriage lateral boundries when said upper carriage is in said travel position;

(i) a forward outer wall section on the same side as said cab and an oppositely disposed rear outer wall section of said upper carriage being substantially parallel to said undercarriage lateral boundries when said upper carriage is in said main excavating position; and, (j) a counterweight having a center of gravity substantially coincident with said fore-and-aft axis of said undercarriage when said upper carriage is in said main excavating position.

* * * * *